US012691985B2

(12) United States Patent
Saruwatari et al.

(10) Patent No.: US 12,691,985 B2
(45) Date of Patent: Jul. 28, 2026

(54) OUTBOARD MOTOR AND MARINE VESSEL

(71) Applicant: YAMAHA HATSUDOKI KABUSHIKI KAISHA, Iwata (JP)

(72) Inventors: Kimitaka Saruwatari, Shizuoka (JP); Tomohiro Hagi, Shizuoka (JP); Yu Wakamizu, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 243 days.

(21) Appl. No.: 18/771,355

(22) Filed: Jul. 12, 2024

(65) Prior Publication Data

US 2025/0026463 A1 Jan. 23, 2025

(30) Foreign Application Priority Data

Jul. 20, 2023 (JP) ..... 2023-118644

(51) Int. Cl.
*B63H 20/12* (2006.01)

(52) U.S. Cl.
CPC ..... *B63H 20/12* (2013.01)

(58) Field of Classification Search
CPC ..... B63H 20/12; B63H 20/16; B63H 20/14; B63H 25/42
See application file for complete search history.

(56) References Cited

U.S. PATENT DOCUMENTS

| | | | | |
|---|---|---|---|---|
| 3,946,698 | A * | 3/1976 | LaFollette | B63H 20/12 440/61 R |
| 8,246,398 | B2 * | 8/2012 | Inaba | B63H 20/12 440/58 |
| 8,246,399 | B2 * | 8/2012 | Inaba | B63H 20/12 440/58 |
| 9,475,560 | B1 * | 10/2016 | Jaszewski | B63H 20/32 |
| 12,606,287 | B2 * | 4/2026 | Saruwatari | B63H 20/12 |
| 2008/0096447 | A1 * | 4/2008 | De Masi | B63H 20/16 440/53 |
| 2010/0173543 | A1 | 7/2010 | Inaba | |
| 2014/0329422 | A1 | 11/2014 | Ito | |
| 2018/0215454 | A1 * | 8/2018 | Weber | B63H 20/12 |
| 2023/0049819 | A1 | 2/2023 | Saruwatari et al. | |
| 2024/0343374 | A1 * | 10/2024 | Andolf | B63H 21/30 |

FOREIGN PATENT DOCUMENTS

| | | | | |
|---|---|---|---|---|
| EP | 4458664 | A1 * | 11/2024 | B63H 20/10 |
| EP | 4574645 | A1 * | 6/2025 | B63H 20/12 |
| IT | 202000025906 | A1 * | 4/2022 | B63H 25/02 |
| JP | 2010149738 | A | 7/2010 | |
| JP | 2010158926 | A | 7/2010 | |
| JP | 2013163439 | A | 8/2013 | |
| JP | 2023026904 | A | 3/2023 | |

* cited by examiner

*Primary Examiner* — Magdalena Topolski
(74) *Attorney, Agent, or Firm* — Keating & Bennett, LLP

(57) ABSTRACT

An outboard motor includes a steering including a first steering to rotate a first lower portion of the outboard motor in a right-left direction with respect to a hull, and a second steering to integrally rotate the first lower portion and a second lower portion of the outboard motor in the right-left direction with respect to the hull. The steering does not rotate an upper portion of the outboard motor in the right-left direction with respect to the hull.

20 Claims, 7 Drawing Sheets

OUTBOARD MOTOR AND MARINE VESSEL

CROSS REFERENCE TO RELATED APPLICATIONS

This application claims the benefit of priority to Japanese Patent Application No. 2023-118644 filed on Jul. 20, 2023. The entire contents of this application are hereby incorporated herein by reference.

BACKGROUND OF THE INVENTION

1. Field of the Invention

The present invention relates to outboard motors and marine vessels.

2. Description of the Related Art

An outboard motor including a lower portion that rotates in a right-left direction with respect to a hull is known in general. Such an outboard motor is disclosed in Japanese Patent Laid-Open No. 2023-026904, for example.

Japanese Patent Laid-Open No. 2023-026904 discloses an outboard motor including an outboard motor main body that includes a lower portion including a propeller and an upper portion including a drive source for the propeller, a first steering mechanism that integrally rotates the upper portion and the lower portion in a right-left direction with respect to a hull, and a second steering mechanism that rotates the lower portion in the right-left direction with respect to the hull.

In the outboard motor disclosed in Japanese Patent Laid-Open No. 2023-026904, the integral rotation of the upper and lower portions in the right-left direction with respect to the hull by the first steering mechanism and the rotation of the lower portion in the right-left direction with respect to the hull by the second steering mechanism are combined such that an angular range in which the outboard motor main body is rotatable in the right-left direction with respect to the hull is relatively increased, but it is necessary to rotate the upper portion including the drive source for the propeller. In such a case, it is necessary to attach the outboard motor main body to the hull taking into consideration that electrical wiring, fuel tubes, etc. connected between the hull and the upper portion swing in the right-left direction when the upper portion is rotated, and thus the attachment structure of the outboard motor main body to the hull is relatively complex. Therefore, it is desired to increase the angular range in which the outboard motor main body is rotatable in the right-left direction with respect to the hull while simplifying the attachment structure of the outboard motor main body to the hull.

SUMMARY OF THE INVENTION

Example embodiments of the present invention provide outboard motors and marine vessels that each increase angular ranges in which outboard motor main bodies are rotatable in a right-left direction with respect to hulls while simplifying attachment structures of the outboard motor main bodies to the hulls.

An outboard motor according to an example embodiment of the present invention includes a bracket, an outboard motor main body attachable to a hull via the bracket and including a lower portion including a first lower portion on which a propeller is provided and a second lower portion above the first lower portion, and an upper portion above the lower portion and including a drive source for the propeller, and a steering to rotate the lower portion in the right-left direction with respect to the hull, and to not rotate the upper portion in a right-left direction with respect to the hull. The steering includes a first steering to rotate the first lower portion in the right-left direction with respect to the hull, and a second steering to integrally rotate the first lower portion and the second lower portion in the right-left direction with respect to the hull.

In an outboard motor according to an example embodiment of the present invention, the steering includes the first steering to rotate the first lower portion in the right-left direction with respect to the hull, and the second steering to integrally rotate the first lower portion and the second lower portion in the right-left direction with respect to the hull. Accordingly, rotation of the first lower portion in the right-left direction with respect to the hull by the first steering and integral rotation of the first lower portion and the second lower portion in the right-left direction with respect to the hull by the second steering are combined such that an angular range in which the outboard motor main body is rotatable in the right-left direction with respect to the hull is relatively increased. Furthermore, in an outboard motor according to an example embodiment of the present invention, the steering is operable to not rotate the upper portion in the right-left direction with respect to the hull. Accordingly, electrical wiring, fuel tubes, etc. connected between the hull and the upper portion do not swing in the right-left direction, and thus the attachment structure of the outboard motor main body to the hull is simplified. Consequently, while the attachment structure of the outboard motor main body to the hull is simplified, the angular range in which the outboard motor main body is rotatable in the right-left direction with respect to the hull is increased.

In an outboard motor according to an example embodiment of the present invention, the first steering and the second steering are preferably operable independently of each other. Accordingly, the angular range in which the outboard motor main body is rotatable in the right-left direction with respect to the hull is a sum of an angular range in which the first lower portion is rotatable in the right-left direction with respect to the hull by the first steering and an angular range in which the first lower portion and the second lower portion are integrally rotatable in the right-left direction with respect to the hull by the second steering, and thus the angular range in which the outboard motor main body is rotatable in the right-left direction with respect to the hull increased or maximized in a structure in which the steering includes the first steering and the second steering.

An outboard motor including the first steering and the second steering operable independently of each other preferably further includes a first steering shaft and a second steering shaft separate from the first steering shaft in the outboard motor main body, the first steering is preferably operable to rotate the first lower portion in the right-left direction about the first steering shaft with respect to the hull, and the second steering is preferably operable to integrally rotate the first lower portion and the second lower portion in the right-left direction about the second steering shaft with respect to the hull. Accordingly, the first lower portion is rotated in the right-left direction with respect to the hull by the first steering while the position of the first steering shaft that is the center of rotation of the first lower portion in the right-left direction with respect to the hull by the first steering is changed by integral rotation of the first lower portion and the second lower portion in the right-left direction with respect to the hull by the second steering. Thus, when a plurality of outboard motors are attached to the hull side by side in the right-left direction, the first steerings rotate the first lower portions in the right-left direction with respect to the hull while the second steerings move the positions of the first steering shafts of the adjacent outboard motors, which are the centers of rotation of the first lower portions in the right-left direction with respect to the hull by the first steerings, away from each other. In such a case, the adjacent outboard motors are less likely to contact each other, and thus an increase in the attachment pitch of the adjacent outboard motors to the hull is reduced or prevented.

In an outboard motor including the first steering operable to rotate the first lower portion in the right-left direction about the first steering shaft with respect to the hull, and the second steering operable to integrally rotate the first lower portion and the second lower portion in the right-left direction about the second steering shaft with respect to the hull, the first lower portion is preferably rotatable in the right-left direction with respect to the hull within a first angular range by the first steering, the first lower portion and the second lower portion are preferably integrally rotatable in the right-left direction with respect to the hull within a second angular range by the second steering, and the first angular range is preferably larger than the second angular range. Accordingly, when a plurality of outboard motors are attached to the hull side by side in the right-left direction, the first lower portions are rotated in the right-left direction with respect to the hull by relatively large angles in the first angular ranges by the first steerings while the positions of the first steering shafts of the adjacent outboard motors, which are the centers of rotation of the first lower portions in the right-left direction with respect to the hull by the first steerings, are moved away from each other. That is, while the adjacent first lower portions are less likely to contact each other, the first steerings effectively rotate the first lower portions in the right-left direction with respect to the hull by the relatively large angles in the first angular ranges.

In an outboard motor in which the first angular range is larger than the second angular range, the first steering preferably includes an electric motor to rotate the first lower portion in the right-left direction with respect to the hull, and the second steering preferably includes a hydraulic pump to integrally rotate the first lower portion and the second lower portion in the right-left direction with respect to the hull. Accordingly, the electric motor directly outputs a rotational motion while the hydraulic pump does not directly output a rotational motion, and thus the first angular range in which the first lower portion is rotatable in the right-left direction with respect to the hull by the first steering including the electric motor that is larger than the second angular range in which the first lower portion and the second lower portion are integrally rotatable in the right-left direction with respect to the hull by the second steering including the hydraulic pump is easily achieved.

In an outboard motor in which the first angular range is larger than the second angular range, the first angular range is preferably 360 degrees. Accordingly, the first steering rotates the first lower portion, on which the propeller is located, in the right-left direction by a desired angle about the first steering shaft, which is the center of rotation, with respect to the hull, and thus good maneuverability is obtained.

In an outboard motor including the first steering operable to rotate the first lower portion in the right-left direction about the first steering shaft with respect to the hull, and the second steering operable to integrally rotate the first lower portion and the second lower portion in the right-left direction about the second steering shaft with respect to the hull, the first steering shaft is preferably rearward of the second steering shaft in the outboard motor main body. Accordingly, the first steering shaft and the second steering shaft are aligned in the forward-rearward direction, and thus integral rotation of the first lower portion and the second lower portion in the right-left direction about the second steering shaft with respect to the hull by the second steering and rotation of the first lower portion in the right-left direction about the first steering shaft with respect to the hull by the first steering are performed in a balanced manner in the right-left direction.

An outboard motor including the first steering operable to rotate the first lower portion in the right-left direction about the first steering shaft with respect to the hull, and the second steering operable to integrally rotate the first lower portion and the second lower portion in the right-left direction about the second steering shaft with respect to the hull preferably further includes a propeller shaft in the first lower portion operable to rotate together with the propeller, and a drive shaft to transmit a driving force from the drive source for the propeller to the propeller shaft. The drive shaft preferably includes a first drive shaft coaxial with the first steering shaft, and a second drive shaft coaxial with the second steering shaft. Accordingly, the first drive shaft is coaxial with the first steering shaft, and thus an increase in a space to provide the first drive shaft and the first steering shaft is reduced or prevented as compared with a case in which the first drive shaft is not coaxial with the first steering shaft. Similarly, the second drive shaft is coaxial with the second steering shaft, and thus an increase in a space to provide the second drive shaft and the second steering shaft is reduced or prevented as compared with a case in which the second drive shaft is not coaxial with the second steering shaft. Furthermore, the first drive shaft is coaxial with the first steering shaft, and thus the first lower portion is rotated by the first steering in the right-left direction about the first steering shaft with respect to the hull without changing the horizontal position of the first drive shaft. Thus, the complexity of the structure of the first steering is reduced or prevented as compared with a case in which the first steering shaft is not coaxial with the first drive shaft. Similarly, the second drive shaft is coaxial with the second steering shaft, and thus the first lower portion and the second lower portion are integrally rotated by the second steering in the right-left direction about the second steering shaft with respect to the hull without changing the horizontal position of the second drive shaft. Thus, the complexity of the structure of the second steering is reduced or prevented as compared with a case in which the second steering shaft is not coaxial with the second drive shaft.

In an outboard motor including the drive shaft including the first drive shaft coaxial with the first steering shaft, and the second drive shaft coaxial with the second steering shaft, the first drive shaft preferably extends through the first steering shaft that is hollow, and the second drive shaft preferably extends through the second steering shaft that is hollow. Accordingly, the first drive shaft coaxial with the first steering shaft is easily achieved, and the second drive shaft coaxial with the second steering shaft is easily achieved.

In an outboard motor including the first steering operable to rotate the first lower portion in the right-left direction about the first steering shaft with respect to the hull, and the second steering operable to integrally rotate the first lower portion and the second lower portion in the right-left direction about the second steering shaft with respect to the hull, the outboard motor preferably includes a plurality of outboard motors, and the first steerings are preferably operable to rotate the first lower portions in the right-left direction about the first steering shafts with respect to the hull while the first lower portions and the second lower portions are integrally rotated in the right-left direction about the second steering shafts with respect to the hull by the second steerings while the first steering shafts are spaced apart from each other. Accordingly, when a plurality of outboard motors are attached to the hull side by side in the right-left direction, the first steerings rotate the first lower portions in the right-left direction with respect to the hull while the second steerings reliably move the positions of the first steering shafts of the adjacent outboard motors, which are the centers of rotation of the first lower portions in the right-left direction with respect to the hull by the first steerings, away from each other.

In an outboard motor according to an example embodiment of the present invention, the steering is preferably operable to rotate the lower portion in the right-left direction with respect to the hull, and to not rotate the upper portion including an engine as the drive source for the propeller in the right-left direction with respect to the hull. Accordingly, the upper portion including the engine as the drive source for the propeller has a relatively large size, and thus an increase in the driving energy to rotate the outboard motor main body in the right-left direction with respect to the hull is effectively reduced or prevented by the steering not rotating the upper portion in the right-left direction with respect to the hull.

A marine vessel according to an example embodiment of the present invention includes a hull, and a plurality of outboard motors attached to the hull side by side in a right-left direction of the marine vessel. Each of the plurality of outboard motors includes an outboard motor main body including a lower portion including a first lower portion on which a propeller is provided and a second lower portion above the first lower portion, and an upper portion above the lower portion and including a drive source for the propeller, and a steering to rotate the lower portion in the right-left direction with respect to the hull, and to not rotate the upper portion in the right-left direction with respect to the hull. The steering includes a first steering to rotate the first lower portion in the right-left direction with respect to the hull, and a second steering to integrally rotate the first lower portion and the second lower portion in the right-left direction with respect to the hull.

In a marine vessel according to an example embodiment of the present invention, the steering includes the first steering to rotate the first lower portion in the right-left direction with respect to the hull, and the second steering to integrally rotate the first lower portion and the second lower portion in the right-left direction with respect to the hull. Accordingly, similarly to the outboard motors according to example embodiments of the present invention described above, an angular range in which the outboard motor main body is rotatable in the right-left direction with respect to the hull is increased while the attachment structure of the outboard motor main body to the hull is simplified.

In a marine vessel according to an example embodiment of the present invention, the first steering and the second steering are preferably operable independently of each other. Accordingly, similarly to the outboard motors according to example embodiments of the present invention described above, the angular range in which the outboard motor main body is rotatable in the right-left direction with respect to the hull is maximized in a structure in which the steering includes the first steering and the second steering.

In a marine vessel including the outboard motors in which the first steering and the second steering are operable independently of each other, each of the plurality of outboard motors preferably further includes a first steering shaft and a second steering shaft separate from the first steering shaft in the outboard motor main body, the first steering is preferably operable to rotate the first lower portion in the right-left direction about the first steering shaft with respect to the hull, and the second steering is preferably operable to integrally rotate the first lower portion and the second lower portion in the right-left direction about the second steering shaft with respect to the hull. Accordingly, similarly to the outboard motors according to example embodiments of the present invention described above, an increase in the attachment pitch of the adjacent outboard motors to the hull is reduced or prevented.

In a marine vessel including the outboard motors in which the first steering is operable to rotate the first lower portion in the right-left direction about the first steering shaft with respect to the hull, and the second steering is operable to integrally rotate the first lower portion and the second lower portion in the right-left direction about the second steering shaft with respect to the hull, the hull preferably includes a controller configured or programmed to control the first steerings and the second steerings of the plurality of outboard motors, and the controller is preferably configured or programmed to control the first steerings of the plurality of outboard motors to rotate the first lower portions in the right-left direction about the first steering shafts with respect to the hull while controlling the second steerings of the plurality of outboard motors to integrally rotate the first lower portions and the second lower portions in the right-left direction about the second steering shafts with respect to the hull while the first steering shafts are spaced apart from each other. Accordingly, when a plurality of outboard motors are attached to the hull side by side in the right-left direction, the first steerings rotate the first lower portions in the right-left direction with respect to the hull while the second steerings reliably move the positions of the first steering shafts of the adjacent outboard motors, which are the centers of rotation of the first lower portions in the right-left direction with respect to the hull by the first steerings, away from each other.

In a marine vessel including the outboard motors in which the first steering is operable to rotate the first lower portion in the right-left direction about the first steering shaft with respect to the hull, and the second steering is operable to integrally rotate the first lower portion and the second lower portion in the right-left direction about the second steering shaft with respect to the hull, the first lower portion is preferably rotatable in the right-left direction with respect to the hull within a first angular range by the first steering, the first lower portion and the second lower portion are preferably integrally rotatable in the right-left direction with respect to the hull within a second angular range by the second steering, and the first angular range is preferably larger than the second angular range. Accordingly, similarly to the outboard motors according to example embodiments of the present invention described above, the first steerings effectively rotate the first lower portions in the right-left direction with respect to the hull by the relatively large angles in the first angular ranges while the adjacent first lower portions are less likely to contact each other.

In a marine vessel including the outboard motors in which the first angular range is larger than the second angular range, the first steering preferably includes an electric motor to rotate the first lower portion in the right-left direction with respect to the hull, and the second steering preferably includes a hydraulic pump to integrally rotate the first lower portion and the second lower portion in the right-left direction with respect to the hull. Accordingly, similarly to the outboard motors according to example embodiments of the present invention described above, the first angular range in which the first lower portion is rotatable in the right-left direction with respect to the hull by the first steering including the electric motor that is larger than the second angular range in which the first lower portion and the second lower portion are integrally rotatable in the right-left direction with respect to the hull by the second steering including the hydraulic pump is easily achieved.

In a marine vessel including the outboard motors in which the first angular range is larger than the second angular range, the first angular range is preferably 360 degrees. Accordingly, similarly to the outboard motors according to example embodiments of the present invention described above, good maneuverability is obtained.

In a marine vessel including the outboard motors in which the first steering is operable to rotate the first lower portion in the right-left direction about the first steering shaft with respect to the hull, and the second steering is operable to integrally rotate the first lower portion and the second lower portion in the right-left direction about the second steering shaft with respect to the hull, the first steering shaft is preferably rearward of the second steering shaft in the outboard motor main body. Accordingly, similarly to the outboard motors according to example embodiments of the present invention described above, integral rotation of the first lower portion and the second lower portion in the right-left direction about the second steering shaft with respect to the hull by the second steering and rotation of the first lower portion in the right-left direction about the first steering shaft with respect to the hull by the first steering are performed in a balanced manner in the right-left direction.

In a marine vessel including the outboard motors in which the first steering is operable to rotate the first lower portion in the right-left direction about the first steering shaft with respect to the hull, and the second steering is operable to integrally rotate the first lower portion and the second lower portion in the right-left direction about the second steering shaft with respect to the hull, each of the plurality of outboard motors preferably further includes a propeller shaft in the first lower portion operable to rotate together with the propeller, and a drive shaft to transmit a driving force from the drive source for the propeller to the propeller shaft, and the drive shaft preferably includes a first drive shaft coaxial with the first steering shaft, and a second drive shaft coaxial with the second steering shaft. Accordingly, similarly to the outboard motors according to example embodiments of the present invention described above, an increase in a space to provide the first drive shaft and the first steering shaft is reduced or prevented as compared with a case in which the first drive shaft is not coaxial with the first steering shaft. Similarly to the outboard motors according to example embodiments of the present invention described above, an increase in a space to provide the second drive shaft and the second steering shaft is reduced or prevented as compared with a case in which the second drive shaft is not coaxial with the second steering shaft. Furthermore, similarly to the outboard motors according to example embodiments of the present invention described above, the complexity of the structure of the first steering is reduced or prevented as compared with a case in which the first steering shaft is not coaxial with the first drive shaft. Similarly to the outboard motors according to example embodiments of the present invention described above, the complexity of the structure of the second steering is reduced or prevented as compared with a case in which the second steering shaft is not coaxial with the second drive shaft.

The above and other elements, features, steps, characteristics and advantages of the present invention will become more apparent from the following detailed description of the example embodiments with reference to the attached drawings.

DETAILED DESCRIPTION OF THE EXAMPLE EMBODIMENTS

Example embodiments of the present invention are hereinafter described with reference to the drawings.

Outboard motors 100 and a marine vessel 120 according to examples embodiment of the present invention are now described with reference to FIGS. 1 to 10. In the figures, arrow FWD, arrow BWD, arrow L, arrow R, arrow Z1, and arrow Z2 represent the front side, the rear side, the left side (port side), the right side (starboard side), the upper side, and the lower side of the marine vessel 120 (outboard motors 100), respectively.

Figure 1:
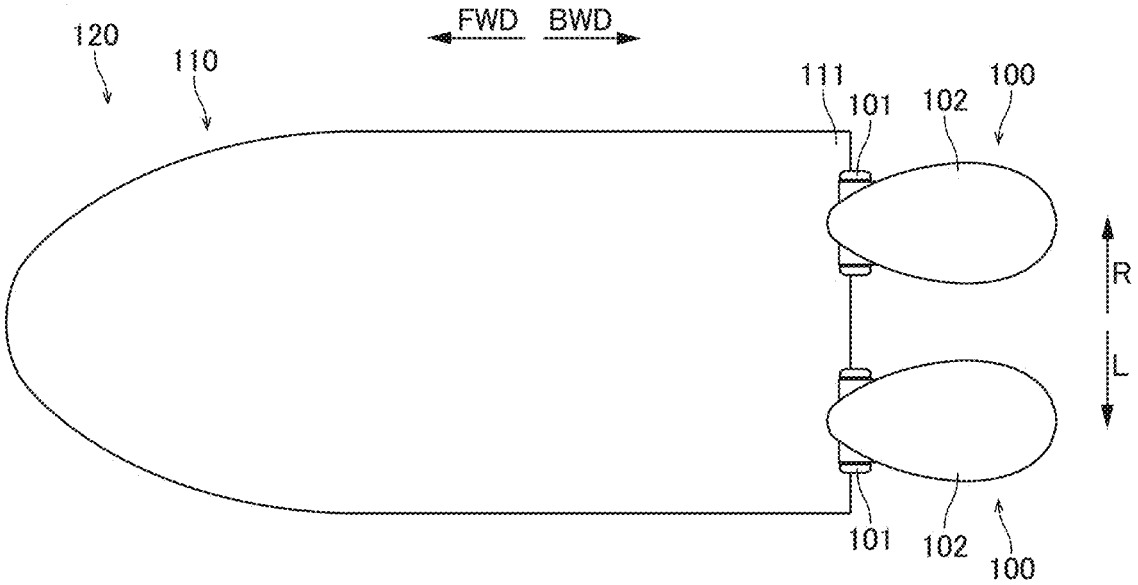
FIG. 1 is a schematic view of a marine vessel according to an example embodiment of the present invention.

As shown in FIG. 1, the marine vessel 120 includes a hull 110 and the outboard motors 100. The outboard motors 100 are marine propulsion devices that propel the hull 110. The outboard motors 100 are attached to a stern 111 of the hull 110. A plurality of (two) outboard motors 100 are attached to the hull 110 side by side in a right-left direction. The marine vessel 120 may be a relatively small marine vessel. The marine vessel 120 may be used for sightseeing or fishing, for example.

Figure 2:
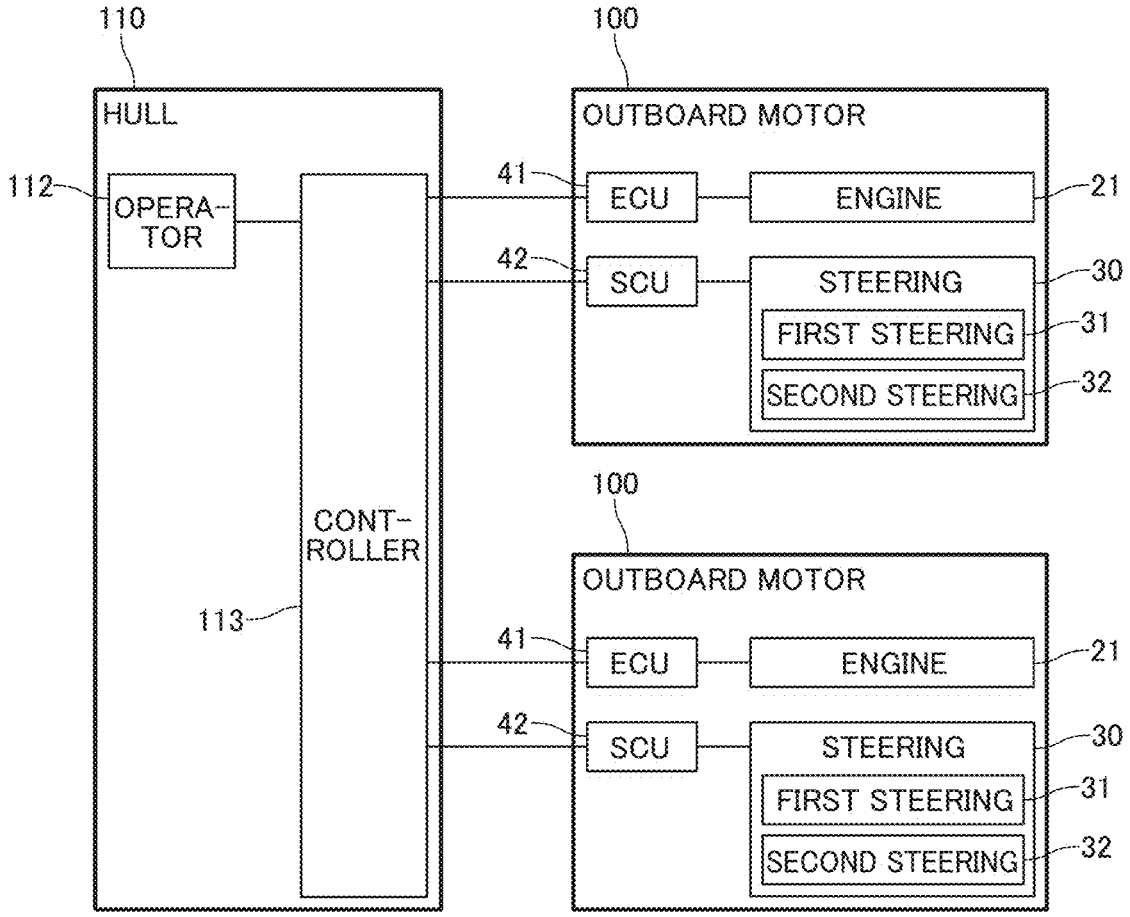
FIG. 2 is a block diagram of a control system of a marine vessel according to an example embodiment of the present invention.

As shown in FIG. 2, the hull 110 includes an operator 112 and a controller 113.

The operator 112 receives an operation to maneuver (operate) the marine vessel 120. The operator 112 includes, for example, a remote control and a steering wheel.

The controller 113 is configured or programmed to control an engine control unit (ECU) 41, a steering control unit (SCU) 42, etc. of each of the plurality of outboard motors 100 based on the operation on the operator 112. The controller 113 may include a computer that includes an arithmetic processing unit such as a central processing unit (CPU), storages such as a read-only memory (ROM) and a random access memory (RAM), etc.

Figure 3:
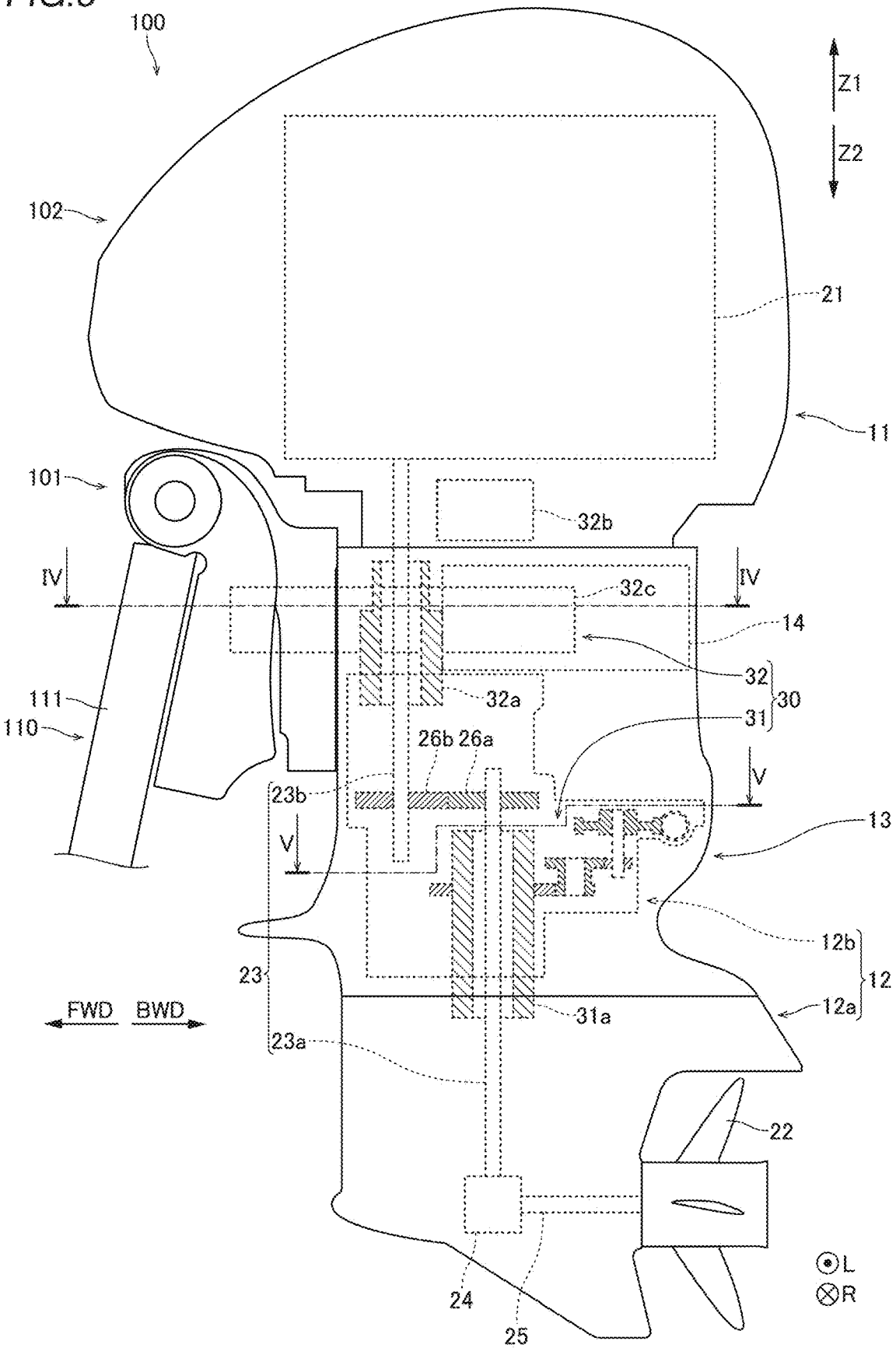
FIG. 3 is a sectional view showing the structure of an outboard motor according to an example embodiment of the present invention.

As shown in FIG. 3, each of the plurality of outboard motors 100 includes a bracket 101 and an outboard motor main body 102. The outboard motor main body 102 is attached to the stern 111 of the hull 110 via the bracket 101.

The outboard motor main body 102 includes a cowling 11, a lower portion 12, an upper case 13, and an oil pan 14. The lower portion 12 includes a lower case 12*a* and a first steering storage case 12*b*. The cowling 11, the upper case 13, and the lower case 12*a* defines a housing of the outboard motor main body 102. The cowling 11 is located in an upper portion of the outboard motor main body 102. An engine 21 is housed inside the cowling 11. That is, the engine 21 is provided in the cowling 11. The lower case 12*a* is located in a lower portion of the outboard motor main body 102. That is, the lower case 12*a* is located below the cowling 11. A propeller 22 is provided on the lower case 12*a*. The upper case 13 is located between the cowling 11 and the lower case 12*a*. The first steering storage case 12*b* is housed inside the upper case 13. That is, the first steering storage case 12*b* is located above the lower case 12*a*. The oil pan 14 is above the first steering storage case 12*b* and inside the upper case 13. The cowling 11 is an example of an "upper portion". The lower case 12*a* is an example of a "first lower portion". The first steering storage case 12*b* is an example of a "second lower portion". The engine 21 is an example of a "drive source for the propeller".

Each of the plurality of outboard motors 100 is an engine outboard motor including the engine 21 to drive the propeller 22. Specifically, the outboard motor main body 102 includes the engine 21, a drive shaft 23, a gearing 24, a propeller shaft 25, and the propeller 22. The engine 21 is, for example, an internal combustion engine that generates a driving force. The drive shaft 23 includes a first drive shaft 23*a* and a second drive shaft 23*b*. The second drive shaft 23*b* is connected to a crankshaft (not shown) of the engine 21. The second drive shaft 23*b* extends in an upward-downward direction within the cowling 11 and the upper case 13. The first drive shaft 23*a* is located rearward of the second drive shaft 23*b* in a forward-rearward direction of the hull 110. The first drive shaft 23*a* is connected to the second drive shaft 23*b* via a gear 26*a* fixed to the first drive shaft 23*a* and a gear 26*b* fixed to the second drive shaft 23*b*. The first drive shaft 23*a* extends in the upward-downward direction across the upper case 13 and the lower case 12*a*. The gearing 24 is located in the lower case 12*a*. The gearing 24 is connected to a lower end of the first drive shaft 23*a*. The propeller shaft 25 is located in the lower case 12*a*. A front end of the propeller shaft 25 is connected to the gearing 24. The propeller shaft 25 extends in the forward-rearward direction behind the gearing 24. The propeller 22 is connected to a rear end of the propeller shaft 25. Thus, the propeller shaft 25 rotates together with the propeller 22. The propeller 22 is located on the lower case 21 to be exposed to the outside of the lower case 12*a*. A driving force is transmitted from the engine 21 to the propeller 22 via the second drive shaft 23*b*, the first drive shaft 23*a*, the gearing 24, and the propeller shaft 25. Thus, the drive shaft 23 transmits a driving force from the engine 21 to the propeller shaft 25. The propeller 22 generates a thrust by rotating in the water due to the driving force transmitted from the engine 21.

Each of the plurality of outboard motors 100 includes a steering 30 to change the orientation of the propeller 22 with respect to the hull 110 so as to change the traveling direction of the marine vessel 120 (see FIG. 1). The steering 30 does not rotate the cowling 11 in the right-left direction with respect to the hull 110. Specifically, the steering 30 does not include a structure to rotate the cowling 11 in the right-left direction with respect to the hull 110. Each of the plurality of outboard motors 100 does not include a structure to rotate the cowling 11 in the right-left direction with respect to the hull 110. The steering 30 rotates the lower portion 12 in the right-left direction with respect to the hull 110. Specifically, the steering 30 includes a first steering 31 to rotate the lower case 12*a* in the right-left direction with respect to the hull 110, and a second steering 32 to integrally rotate (i.e., rotate together) the lower case 12*a* and the first steering storage case 12*b* in the right-left direction with respect to the hull 110. The steering 30 is described below in detail.

As shown in FIG. 2, each of the plurality of outboard motors 100 includes the ECU 41 to control the engine 21 and the SCU 42 to control the steering 30. The ECU 41 controls driving of the engine 21 based on a control by the controller 113 provided on the hull 110. The SCU 42 controls driving of the steering 30 based on a control by the controller 113. That is, the controller 113 on the hull 110 controls the first steering 31 and the second steering 32 of each of the plurality of outboard motors 100. The ECU 41 and the SCU 42 may include, for example, computers that each include an arithmetic processing unit such as a CPU, storages such as a ROM and a RAM, etc.

Figure 4:
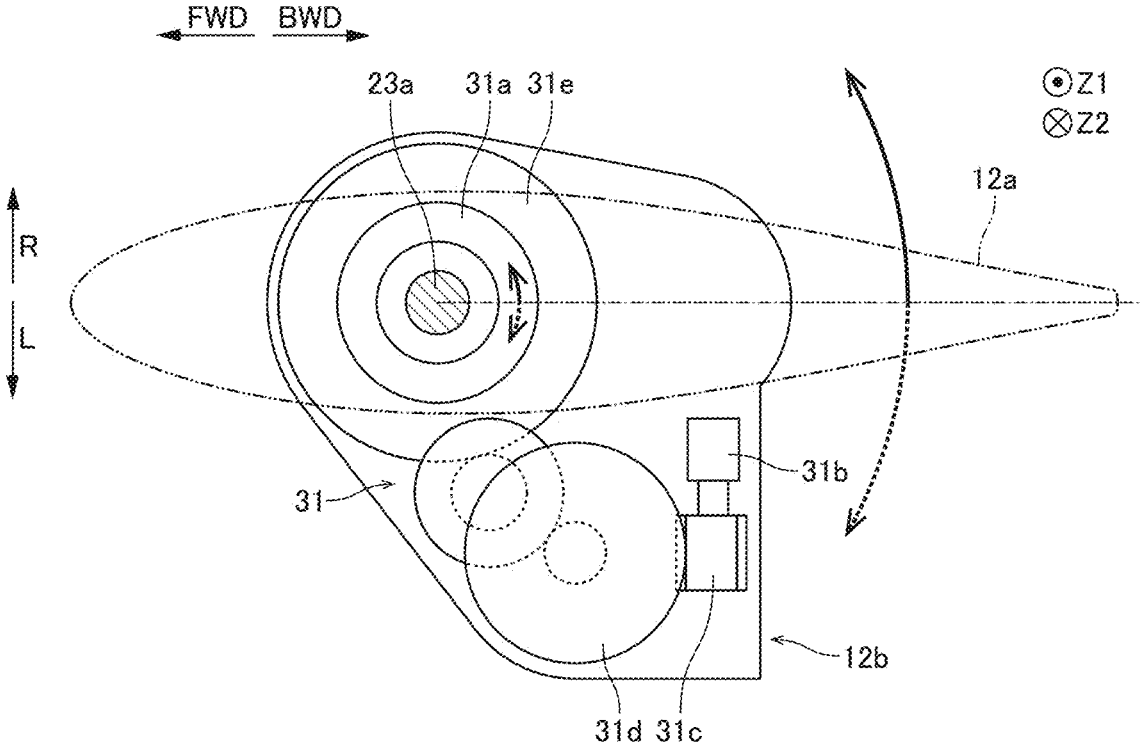
FIG. 4 is a sectional view taken along the line IV-IV in FIG. 3.

As shown in FIG. 3, the first steering 31 rotates the lower case 12*a* in the right-left direction about a first steering shaft 31*a* provided in the outboard motor main body 102 with respect to the hull 110. Specifically, as shown in FIG. 4, the first steering 31 includes an electric motor 31*b*, a worm 31*c*, a worm wheel 31*d*, a first steering shaft side gear 31*e*, and the first steering shaft 31*a*. The electric motor 31*b* is a drive source to rotate the lower case 12*a* in the right-left direction with respect to the hull 110. An output shaft of the electric motor 31*b* is connected to the worm 31*c*. The worm wheel 31*d* defines a worm gear together with the worm 31*c*. That is, teeth of the worm 31*c* mesh with teeth of the worm wheel 31*d*. A plurality of gears that mesh with each other are provided between the worm 31*c* and the first steering shaft side gear 31*e*. The first steering shaft side gear 31*e* is fixed to the first steering shaft 31*a*. That is, when the first steering shaft side gear 31*e* rotates, the first steering shaft 31*a* rotates. A driving force is transmitted from the electric motor 31*b* to the first steering shaft 31*a* via the worm 31*c*, the worm wheel 31*d*, the plurality of gears between the worm 31*c* and the first steering shaft side gear 31*e*, and the first steering shaft side gear 31*e*. As shown in FIG. 3, a lower end of the first steering shaft 31*a* is fixed to the lower case 12*a*. Therefore, when the first steering shaft 31*a* rotates in the right-left direction, the lower case 12*a* rotates in the right-left direction about the first steering shaft 31*a* with respect to the hull 110. The first steering 31, except for the lower end of the first steering shaft 31*a*, is housed in the first steering storage case 12*b*.

The first drive shaft 23*a* extends through the inside of the first steering shaft 31*a*. That is, the first drive shaft 23*a* extends through the hollow first steering shaft 31*a*. The first drive shaft 23*a* is coaxial with the first steering shaft 31*a*.

Figure 5:
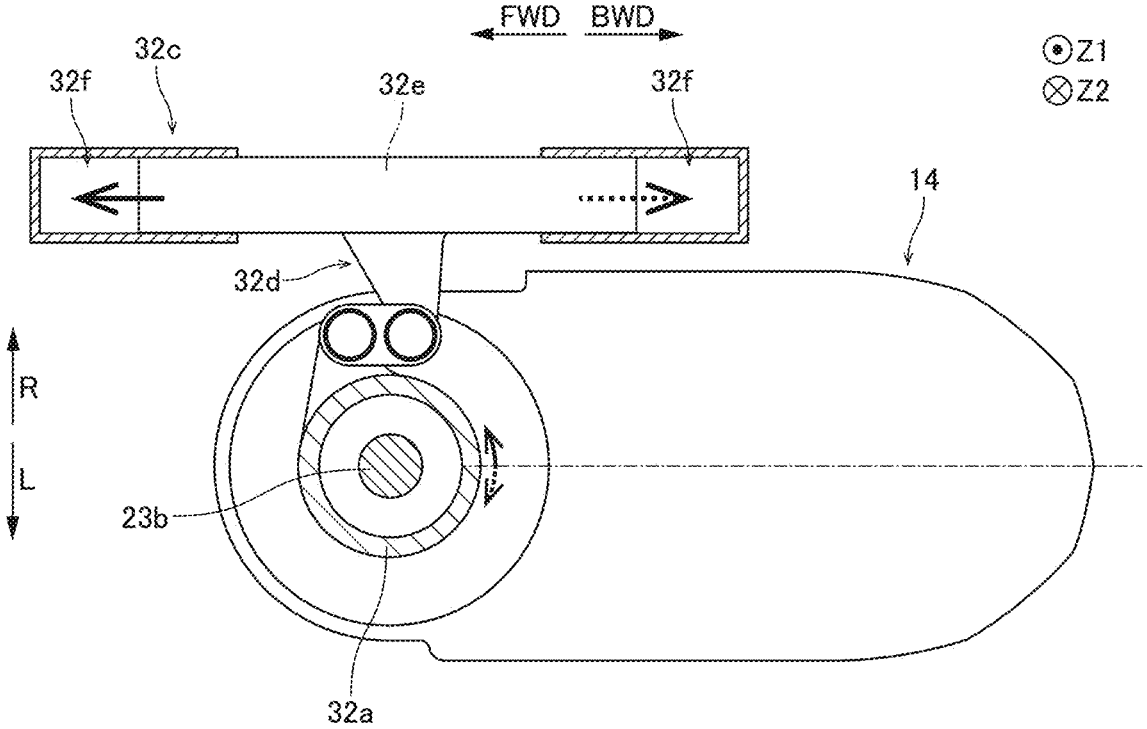
FIG. 5 is a sectional view taken along the line V-V in FIG. 3.

The second steering 32 integrally rotates the lower case 12*a* and the first steering storage case 12*b* in the right-left direction about a second steering shaft 32*a* provided in the outboard motor main body 102 separately from the first steering shaft 31*a* with respect to the hull 110. Specifically, as shown in FIG. 5, the second steering 32 includes a hydraulic pump 32*b* (see FIG. 3), a hydraulic cylinder 32*c*, a link 32*d*, and a second steering shaft 32*a*. The hydraulic pump 32*b* is a drive source to integrally rotate the lower case 12*a* and the first steering storage case 12*b* in the right-left direction with respect to the hull 110. The hydraulic cylinder 32*c* extends along the forward-rearward direction. A linear motion member 32*e* is housed inside the hydraulic cylinder 32*c*. Two oil chambers 32*f* are provided inside the hydraulic cylinder 32*c*. The two oil chambers 32*f* are provided on the front side and the rear side of the linear motion member 32*e*. The hydraulic pump 32*b* is driven such that hydraulic oil is supplied to one of the two oil chambers 32*f*, and hydraulic oil is discharged from the other of the two oil chambers 32*f*. The amount of hydraulic oil in the two oil chambers 32*f* is adjusted such that the linear motion member 32*e* linearly moves along the forward-rearward direction inside the hydraulic cylinder 32*c*. The second steering shaft 32*a* is connected to the linear motion member 32*e* via the link 32*d*. A driving force is transmitted from the hydraulic pump 32*b* to the second steering shaft 32*a* via the linear motion member 32*e* and the link 32*d*. That is, the second steering shaft 32*a* rotates in the right-left direction as the linear motion member 32*e* linearly moves in the forward-rearward direction. In FIG. 5, illustration of the upper case 13 and the bracket 101 is omitted. As shown in FIG. 3, a lower end of the second steering shaft 32*a* is fixed to the first steering storage case 12*b*. Therefore, when the second steering shaft 32*a* rotates in the right-left direction, the first steering storage case 12*b* rotates in the right-left direction. As described above, the lower end of the first steering shaft 31*a* is fixed to the lower case 12*a*, and thus when the second steering shaft 32*a* rotates in the right-left direction, the lower case 12*a* and the first steering storage case 12*b* integrally rotate in the right-left direction about the second steering shaft 32*a*.

The second steering shaft 32*a*, the link 32*d*, and the hydraulic cylinder 32*c* are located in an upper portion of the upper case 13. The hydraulic cylinder 32*c* is located below the cowling 11.

The second drive shaft 23*b* extends through the inside of the second steering shaft 32*a*. That is, the second drive shaft 23*b* extends through the hollow second steering shaft 32*a*. The second drive shaft 23*b* is coaxial with the second steering shaft 32*a*. As described above, the first drive shaft 23*a* is located rearward of the second drive shaft 23*b* in the forward-rearward direction. That is, the first steering shaft 31*a* is located rearward of the second steering shaft 32*a* in the outboard motor main body 102.

Figure 6:
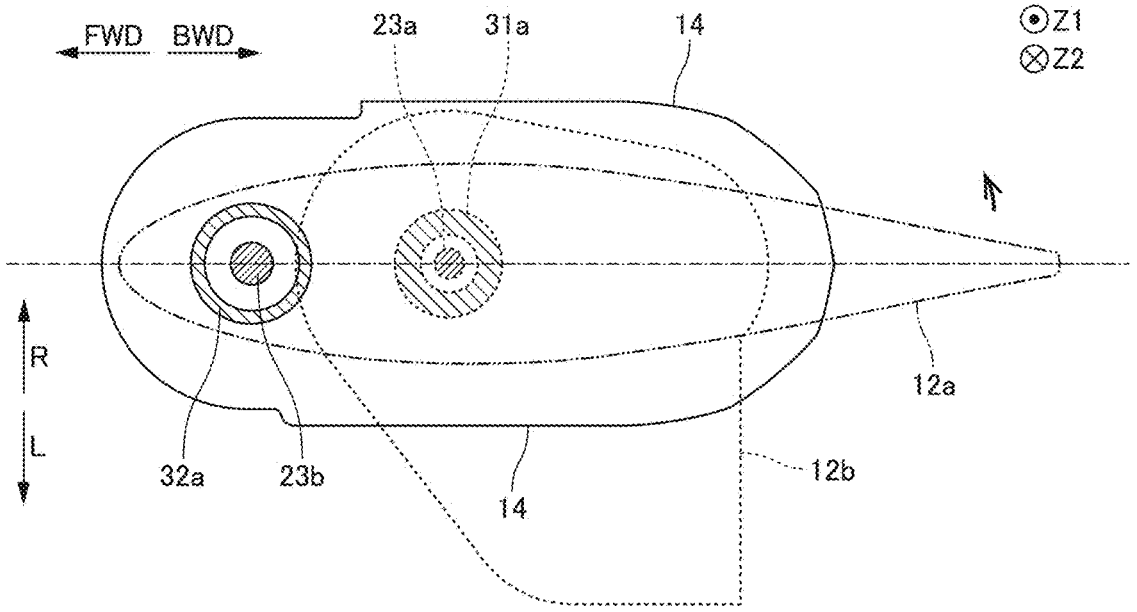
FIG. 6 is a schematic view showing a lower case, a first steering storage case, and an oil pan according to an example embodiment of the present invention.
Figure 7:
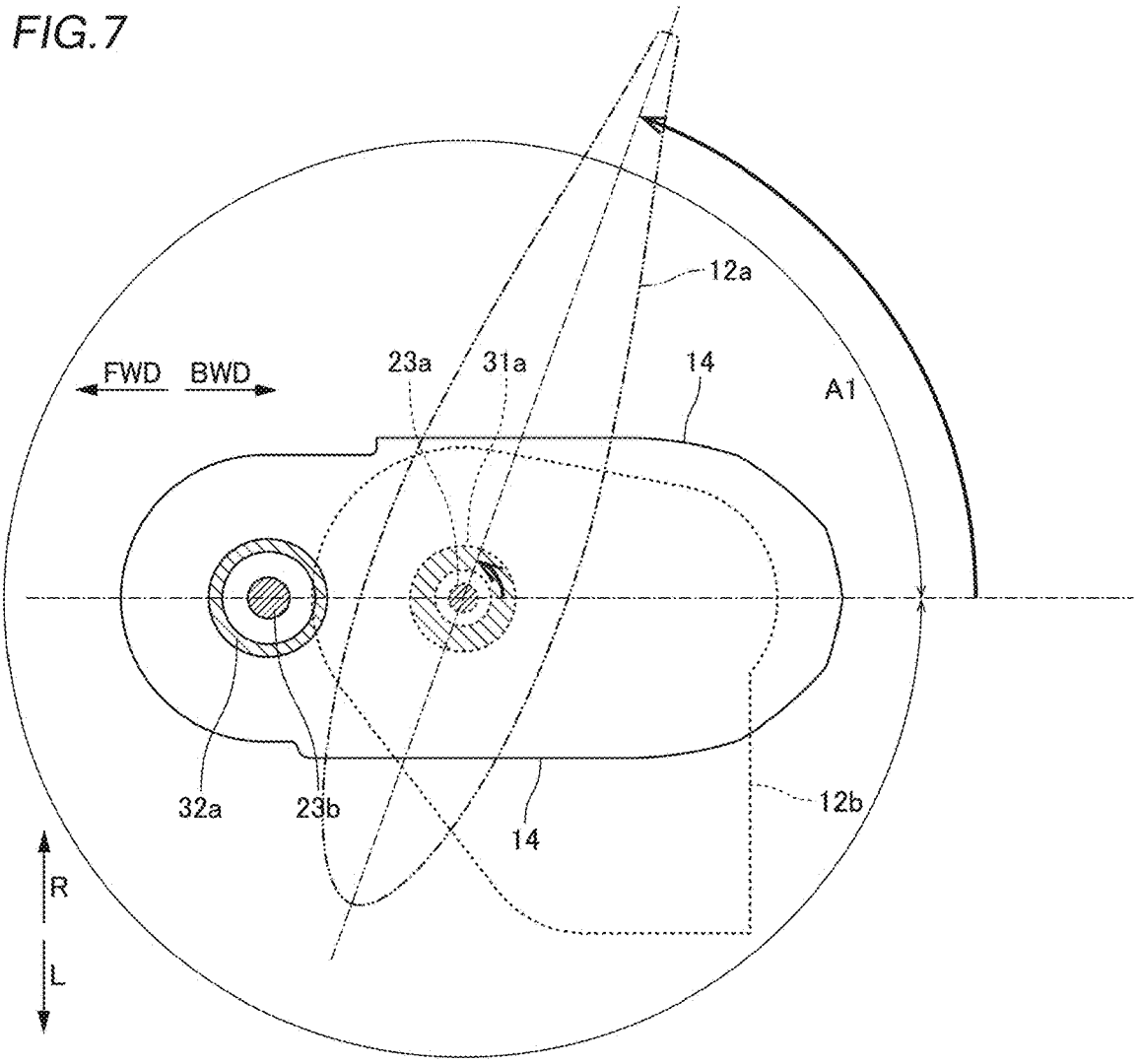
FIG. 7 is a diagram showing a state in which a lower case is rotated from the state shown in FIG. 6.
Figure 8:
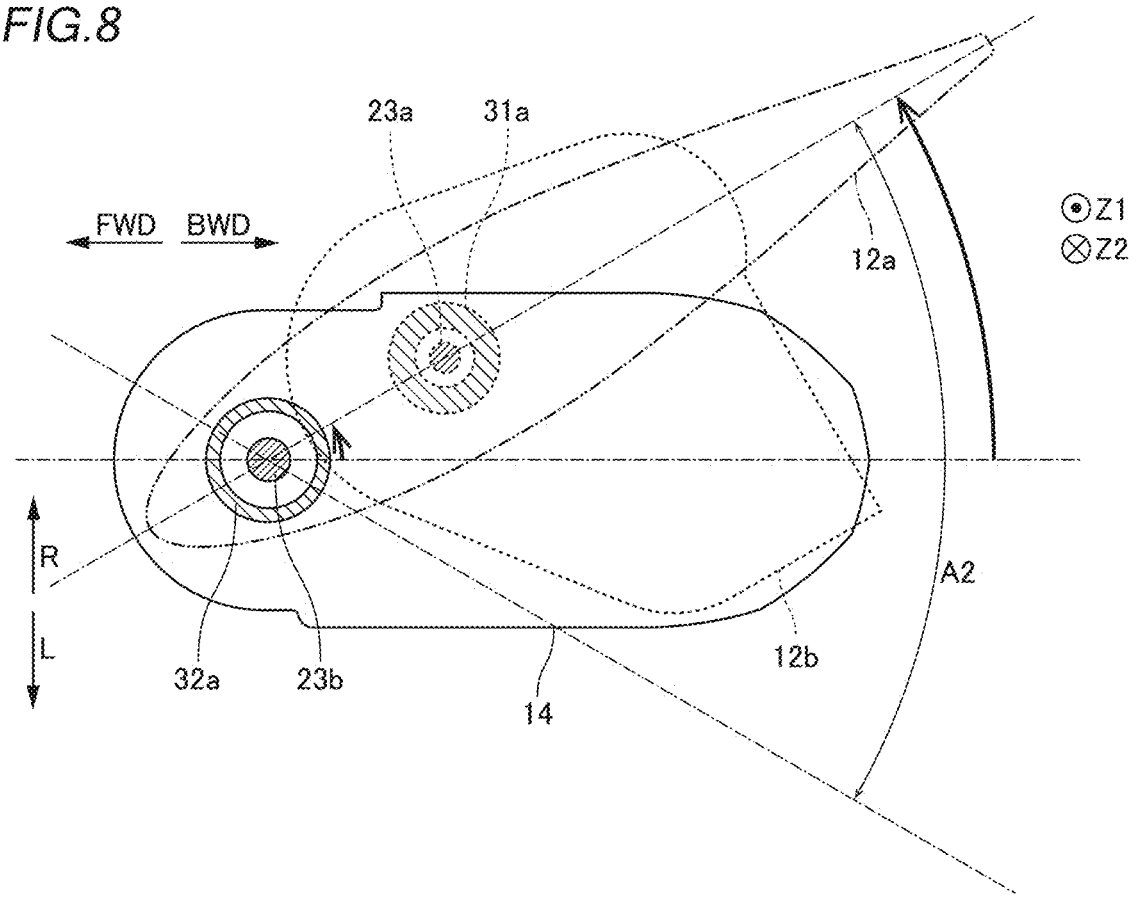
FIG. 8 is a diagram showing a state in which a lower case and a first steering storage case are integrally rotated from the state shown in FIG. 6.

As shown in FIGS. 6 to 8, a first angular range A1 in which the lower case 12*a* is rotatable in the right-left direction with respect to the hull 110 (see FIG. 3) by the first steering 31 (see FIG. 3) is larger than a second angular range A2 in which the lower case 12*a* and the first steering storage case 12*b* are integrally rotatable in the right-left direction with respect to the hull 110 by the second steering 32. Specifically, as shown in FIG. 7, the first angular range A1 is 360 degrees. As shown in FIG. 8, the second angular range A2 is 30 degrees, for example. FIG. 7 shows a state in which the first steering 31 rotates the lower case 12*a* to the right by about 80 degrees with respect to the hull 110 from the state shown in FIG. 6. FIG. 8 shows a state in which the second steering 32 integrally rotates the lower case 12*a* and the first steering storage case 12*b* to the right by about 30 degrees with respect to the hull 110 from the state shown in FIG. 6.

Figure 9:
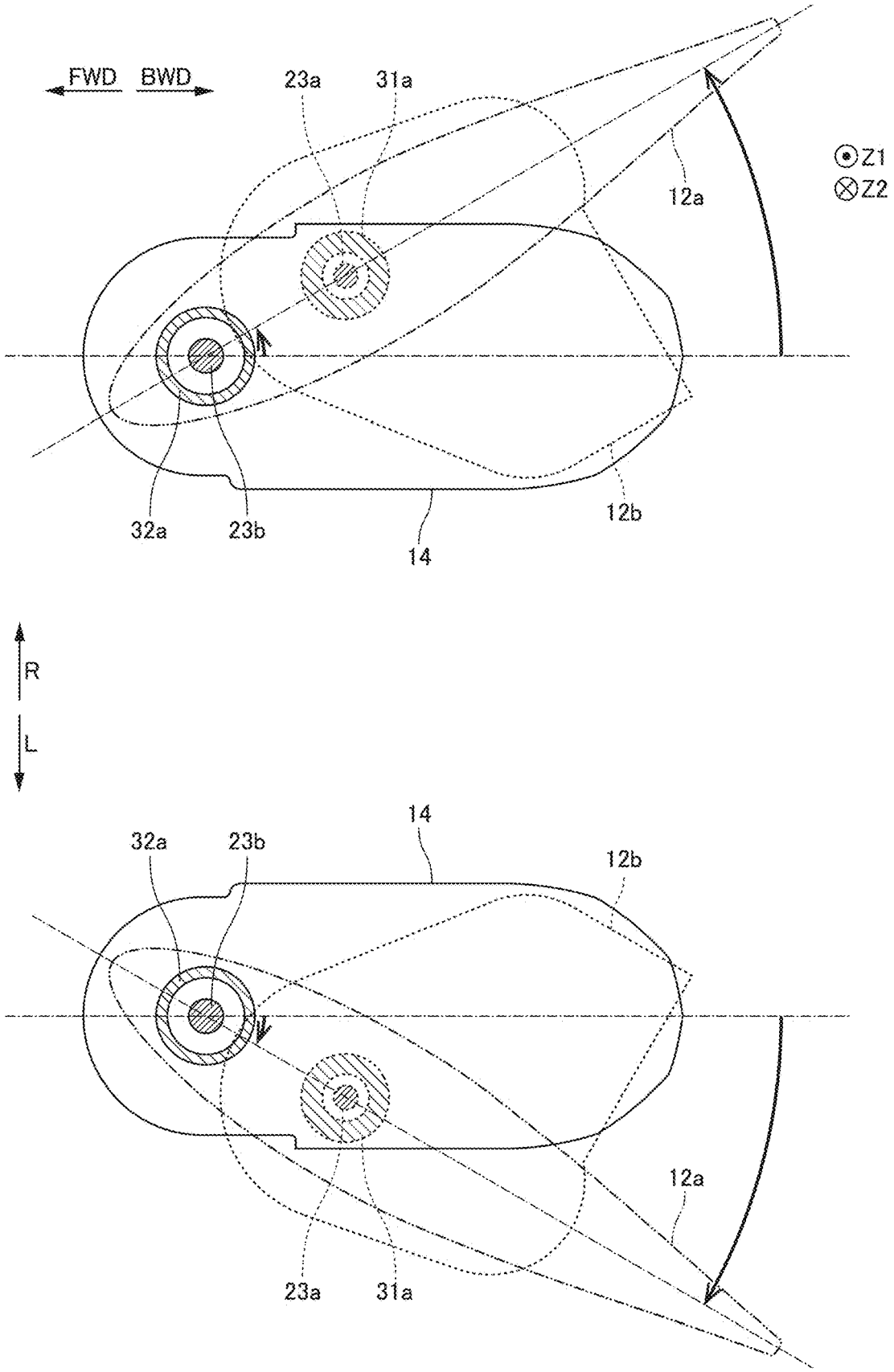
FIG. 9 is a diagram showing a state in which second steerings integrally rotate lower cases and first steering storage cases in a right-left direction about second steering shafts with respect to a hull while first steering shafts are spaced apart from each other between adjacent outboard motors according to an example embodiment of the present invention.
Figure 10:
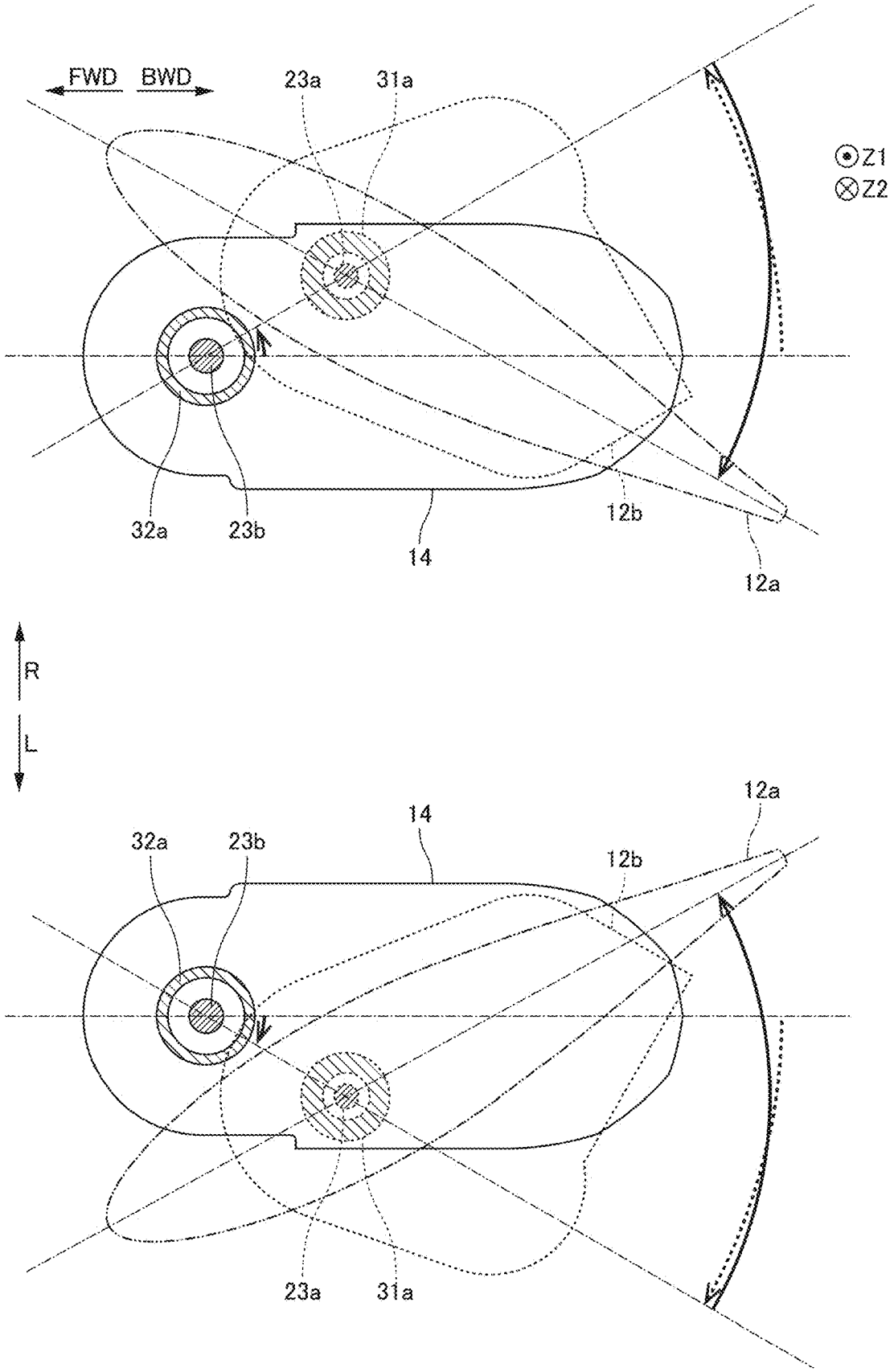
FIG. 10 is a diagram showing a state in which first steerings rotate lower cases in a right-left direction about first steering shafts with respect to a hull from the state shown in FIG. 9.

As shown in FIGS. 9 and 10, the controller 113 (see FIG. 2) controls the first steerings 31 of the plurality of outboard motors 100 to rotate the lower cases 12*a* in the right-left direction about the first steering shafts 31*a* with respect to the hull 110 while controlling the second steerings 32 of the plurality of outboard motors 100 to integrally rotate the lower cases 12*a* and the first steering storage cases 12*b* in the right-left direction about the second steering shafts 32*a* with respect to the hull 110 while the first steering shafts 31*a* are spaced apart from each other between the adjacent outboard motors 100 (see FIG. 1). That is, in the outboard motors 100, the first steerings 31 rotate the lower cases 12*a* in the right-left direction about the first steering shafts 31*a* with respect to the hull 110 while the second steerings 32 integrally rotate the lower cases 12*a* and the first steering storage cases 12*b* in the right-left direction about the second steering shafts 32*a* with respect to the hull 110 while the first steering shafts 31*a* are spaced apart from each other between the adjacent outboard motors 100.

Specifically, as shown in FIG. 9, the controller 113 (see FIG. 2) first controls the SCU 42 (see FIG. 2) of the right outboard motor 100 to cause the second steering 32 to integrally rotate the lower case 12*a* and the first steering storage case 12*b* to the right about the second steering shaft 32*a* with respect to the hull 110 (see FIG. 1), and controls the SCU 42 of the left outboard motor 100 to cause the second steering 32 to integrally rotate the lower case 12*a* and the first steering storage case 12*b* to the left about the second steering shaft 32*a* with respect to the hull 110. Thus, the first steering shaft 31*a* of the right outboard motor 100 and the first steering shaft 31*a* of the left outboard motor 100 move away from each other in the right-left direction. An angle at which the second steering 32 integrally rotates the lower case 12*a* and the first steering storage case 12*b* to the right about the second steering shaft 32*a* with respect to the hull 110 in the right outboard motor 100, and an angle at which the second steering 32 integrally rotates the lower case 12*a* and the first steering storage case 12*b* to the left about the second steering shaft 32*a* with respect to the hull 110 in the left outboard motor 100 may be equal to or different from each other.

Then, as shown in FIG. 10, the controller 113 (see FIG. 2) controls the SCU 42 (see FIG. 2) of the right outboard motor 100 (see FIG. 1) to cause the first steering 31 to rotate the lower case 12*a* in the right-left direction about the first steering shaft 31*a* with respect to the hull 110, and controls the SCU 42 of the left outboard motor 100 to cause the first steering 31 to rotate the lower case 12*a* in the right-left direction about the first steering shaft 31*a* with respect to the hull 110. An angle at which the first steering 31 rotates the lower case 12*a* in the right-left direction about the first steering shaft 31*a* with respect to the hull 110 in the right outboard motor 100, and an angle at which the first steering 31 rotates the lower case 12*a* in the right-left direction about the first steering shaft 31*a* with respect to the hull 110 in the left outboard motor 100 may be equal to or different from each other. FIG. 10 shows an example in which in the right outboard motor 100, the first steering 31 rotates the lower case 12*a* to the left about the first steering shaft 31*a* with respect to the hull 110, and in the left outboard motor 100, the first steering 31 rotates the lower case 12*a* to the right about the first steering shaft 31*a* with respect to the hull 110.

According to the various example embodiments of the present invention described above, the following advantageous effects are achieved.

According to an example embodiment of the present invention, the steering 30 includes the first steering 31 to rotate the lower case 12*a* (first lower portion) in the right-left direction with respect to the hull 110, and the second steering 32 to integrally rotate the lower case 12*a* and the first steering storage case 12*b* (second lower portion) in the right-left direction with respect to the hull 110. Accordingly, rotation of the lower case 12*a* in the right-left direction with respect to the hull 110 by the first steering 31 and integral rotation of the lower case 12*a* and the first steering storage case 12*b* in the right-left direction with respect to the hull 110 by the second steering 32 are combined such that an angular range in which the outboard motor main body 102 is rotatable in the right-left direction with respect to the hull 110 is relatively increased. Furthermore, according to an example embodiment of the present invention, the steering 30 is operable to not rotate the cowling 11 (upper portion) in the right-left direction with respect to the hull 110. Accordingly, electrical wiring, fuel tubes, etc. connected between the hull 110 and the cowling 11 do not swing in the right-left direction, and thus the attachment structure of the outboard motor main body 102 to the hull 110 is simplified. Consequently, while the attachment structure of the outboard motor main body 102 to the hull 110 is simplified, the angular range in which the outboard motor main body 102 is rotatable in the right-left direction with respect to the hull 110 is increased.

According to an example embodiment of the present invention, the first steering 31 and the second steering 32 are operable independently of each other. Accordingly, the angular range in which the outboard motor main body 102 is rotatable in the right-left direction with respect to the hull 110 is the sum of an angular range (first angular range A1) in which the lower case 12*a* (first lower portion) is rotatable in the right-left direction with respect to the hull 110 by the first steering 31 and an angular range (second angular range A2) in which the lower case 12*a* and the first steering storage case 12*b* (second lower portion) are integrally rotatable in the right-left direction with respect to the hull 110 by the second steering 32, and thus the angular range in which the outboard motor main body 102 is rotatable in the right-left direction with respect to the hull 110 is maximized in a structure in which the steering 30 includes the first steering 31 and the second steering 32.

According to an example embodiment of the present invention, the first steering shaft 31*a* is provided in the outboard motor main body 102, and the first steering 31 is operable to rotate the lower case 12*a* (first lower portion) in the right-left direction about the first steering shaft 31*a* with respect to the hull 110. Furthermore, the second steering shaft 32*a* is provided in the outboard motor main body 102 separately from the first steering shaft 31*a*, and the second steering 32 is operable to integrally rotate the lower case 12*a* and the first steering storage case 12*b* (second lower portion) in the right-left direction about the second steering shaft 32*a* with respect to the hull 110. Accordingly, the lower case 12*a* is rotated in the right-left direction with respect to the hull 110 by the first steering 31 while the position of the first steering shaft 31*a* that is the center of rotation of the lower case 12*a* in the right-left direction with respect to the hull 110 by the first steering 31 is changed by integral rotation of the lower case 12*a* and the first steering storage case 12*b* in the right-left direction with respect to the hull 110 by the second steering 32. Thus, when a plurality of outboard motors 100 are attached to the hull 110 side by side in the right-left direction, the first steerings 31 rotate the lower cases 12*a* in the right-left direction with respect to the hull 110 while the second steerings 32 move the positions of the first steering shafts 31*a* of the adjacent outboard motors 100, which are the centers of rotation of the lower cases 12*a* in the right-left direction with respect to the hull 110 by the first steerings 31, away from each other. In such a case, the adjacent outboard motors 100 are less likely to contact each other, and thus an increase in the attachment pitch of (distance between) the adjacent outboard motors 100 to the hull 110 is reduced or prevented.

According to an example embodiment of the present invention, the first angular range A1 in which the lower case 12*a* (first lower portion) is rotatable in the right-left direction with respect to the hull 110 by the first steering 31 is larger than the second angular range A2 in which the lower case 12*a* and the first steering storage case 12*b* (second lower portion) are integrally rotatable in the right-left direction with respect to the hull 110 by the second steering 32. Accordingly, when a plurality of outboard motors 100 are attached to the hull 110 side by side in the right-left direction, the lower cases 12*a* are rotated in the right-left direction with respect to the hull 110 by relatively large angles in the first angular ranges A1 by the first steerings 31 while the positions of the first steering shafts 31*a* of the adjacent outboard motors 100, which are the centers of rotation of the lower cases 12*a* in the right-left direction with respect to the hull 110 by the first steerings 31, are moved away from each other. That is, while the adjacent lower cases 12*a* are less likely to contact each other, the first steerings 31 effectively rotate the lower cases 12*a* in the right-left direction with respect to the hull 110 by the relatively large angles in the first angular ranges A1.

According to an example embodiment of the present invention, the first steering 31 includes the electric motor 31*b* to rotate the lower case 12*a* (first lower portion) in the right-left direction with respect to the hull 110. Furthermore, the second steering 32 includes the hydraulic pump 32*b* to integrally rotate the lower case 12*a* and the first steering storage case 12*b* (second lower portion) in the right-left direction with respect to the hull 110. Accordingly, the electric motor 31*b* directly outputs a rotational motion while the hydraulic pump 32*b* does not directly output a rotational motion, and thus the first angular range A1 in which the lower case 12*a* is rotatable in the right-left direction with respect to the hull 110 by the first steering 31 including the electric motor 31*b* that is larger than the second angular range A2 in which the lower case 12*a* and the first steering storage case 12*b* are integrally rotatable in the right-left direction with respect to the hull 110 by the second steering 32 including the hydraulic pump 32*b* is easily achieved.

According to an example embodiment of the present invention, the first angular range A1 is 360 degrees. Accordingly, the first steering 31 rotates the lower case 12*a* (first lower portion), on which the propeller 22 is located, in the right-left direction by a desired angle about the first steering shaft 31*a*, which is the center of rotation, with respect to the hull 110, and thus good maneuverability is obtained.

According to an example embodiment of the present invention, the first steering shaft 31*a* is located rearward of the second steering shaft 32*a* in the outboard motor main body 102. Accordingly, the first steering shaft 31*a* and the second steering shaft 32*a* are aligned in the forward-rearward direction, and thus integral rotation of the lower case 12*a* (first lower portion) and the first steering storage case 12*b* (second lower portion) in the right-left direction about the second steering shaft 32*a* with respect to the hull 110 by the second steering 32 and rotation of the lower case 12*a* in the right-left direction about the first steering shaft 31*a* with respect to the hull 110 by the first steering 31 are performed in a balanced manner in the right-left direction.

According to an example embodiment of the present invention, the outboard motor 100 includes the propeller shaft 25 in the lower case 12*a* (first lower portion) operable to rotate together with the propeller 22, and the drive shaft 23 to transmit a driving force from the engine 21 (a drive source for the propeller 22) to the propeller shaft 25. Furthermore, the drive shaft 23 includes the first drive shaft 23*a* coaxial with the first steering shaft 31*a*, and the second drive shaft 23*b* coaxial with the second steering shaft 32*a*. Accordingly, the first drive shaft 23*a* is coaxial with the first steering shaft 31*a*, and thus an increase in a space to provide the first drive shaft 23*a* and the first steering shaft 31*a* is reduced or prevented as compared with a case in which the first drive shaft 23*a* is not coaxial with the first steering shaft 31*a*. Similarly, the second drive shaft 23*b* is coaxial with the second steering shaft 32*a*, and thus an increase in a space to provide the second drive shaft 23*b* and the second steering shaft 32*a* is reduced or prevented as compared with a case in which the second drive shaft 23*b* is not coaxial with the second steering shaft 32*a*. Furthermore, the first drive shaft 23*a* is coaxial with the first steering shaft 31*a*, and thus the lower case 12*a* is rotated by the first steering 31 in the right-left direction about the first steering shaft 31*a* with respect to the hull 110 without changing the horizontal position of the first drive shaft 23*a*. Thus, the complexity of the structure of the first steering 31 is reduced or prevented as compared with a case in which the first steering shaft 31*a* is not coaxial with the first drive shaft 23*a*. Similarly, the second drive shaft 23*b* is coaxial with the second steering shaft 32*a*, and thus the lower case 12*a* and the first steering storage case 12*b* (second lower portion) are integrally rotated by the second steering 32 in the right-left direction about the second steering shaft 32*a* with respect to the hull 110 without changing the horizontal position of the second drive shaft 23*b*. Thus, the complexity of the structure of the second steering 32 is reduced or prevented as compared with a case in which the second steering shaft 32*a* is not coaxial with the second drive shaft 23*b*.

According to an example embodiment of the present invention, the first drive shaft 23*a* passes through the hollow first steering shaft 31*a*. Furthermore, the second drive shaft 23*b* passes through the hollow second steering shaft 32*a*. Accordingly, the first drive shaft 23*a* coaxial with the first steering shaft 31*a* is easily achieved, and the second drive shaft 23*b* coaxial with the second steering shaft 32*a* is easily achieved.

According to an example embodiment of the present invention, the hull 110 includes the controller 113 configured or programmed to control the first steerings 31 and the second steerings 32 of the plurality of outboard motors 100. Furthermore, the controller 113 is configured or programmed to control the first steerings 31 of the plurality of outboard motors 100 to rotate the lower cases 12*a* in the right-left direction about the first steering shafts 31*a* with respect to the hull 110 while controlling the second steerings 32 of the plurality of outboard motors 100 to integrally rotate the lower cases 12*a* (first lower portions) and the first steering storage cases 12*b* (second lower portions) in the right-left direction about the second steering shafts 32*a* with respect to the hull 110 while the first steering shafts 31*a* are spaced apart from each other between the adjacent outboard motors 100. That is, in the outboard motors 100, the first steerings 31 rotate the lower cases 12*a* in the right-left direction about the first steering shafts 31*a* with respect to the hull 110 while the second steerings 32 integrally rotate the lower cases 12*a* and the first steering storage cases 12*b* in the right-left direction about the second steering shafts 32*a* with respect to the hull 110 such that the first steering shafts 31*a* are spaced apart from each other between the adjacent outboard motors 100. Accordingly, when a plurality of outboard motors 100 are attached to the hull 110 side by side in the right-left direction, the first steerings 31 rotate the lower cases 12*a* in the right-left direction with respect to the hull 110 while the second steerings 32 reliably move the positions of the first steering shafts 31*a* of the adjacent outboard motors 100, which are the centers of rotation of the lower cases 12*a* in the right-left direction with respect to the hull 110 by the first steerings 31, away from each other.

According to an example embodiment of the present invention, the steering 30 is operable to not rotate the cowling 11 (upper portion) including the engine 21 for the propeller 22 in the right-left direction with respect to the hull 110, and to rotate the lower portion 12 in the right-left direction with respect to the hull 110. Accordingly, the cowling 11 including the engine 21 for the propeller 22 has a relatively large size, and thus an increase in the driving energy to rotate the outboard motor main body 102 in the right-left direction with respect to the hull 110 is effectively reduced or prevented by the steering 30 not rotating the cowling 11 in the right-left direction with respect to the hull 110.

The example embodiments of the present invention described above are illustrative in all points and not restrictive. The extent of the present invention is not defined by the above description of the example embodiments but by the scope of the claims, and all modifications within the meaning and range equivalent to the scope of the claims are further included.

For example, while the steering 30 preferably does not rotate the cowling 11 (upper portion) including the engine 21 for the propeller 22 in the right-left direction with respect to the hull 110 and rotates the lower portion 12 in the right-left direction with respect to the hull 110 in example embodiments described above, the present invention is not restricted to this. In an example embodiment of the present invention, the steering may not rotate the upper portion including an electric motor for the propeller in the right-left direction with respect to the hull and may rotate the lower portion in the right-left direction with respect to the hull.

While in the outboard motors 100, the first steerings 31 preferably rotate the lower cases 12*a* in the right-left direction about the first steering shafts 31*a* with respect to the hull 110 while the second steerings 32 integrally rotate the lower cases 12*a* (first lower portions) and the first steering storage cases 12*b* (second lower portions) in the right-left direction about the second steering shafts 32*a* with respect to the hull 110 while the first steering shafts 31*a* are spaced apart from each other between the adjacent outboard motors 100 in example embodiments described above, the present invention is not restricted to this. In an example embodiment of the present invention, in the outboard motors, the first steerings may alternatively rotate the first lower portions in the right-left direction about the first steering shafts with respect to the hull while the second steerings integrally rotate the first lower portions and the second lower portions in the right-left direction about the second steering shafts with respect to the hull such that the positions of the first steering shafts do not change between the adjacent outboard motors.

While the first drive shaft 23*a* preferably extends through the hollow first steering shaft 31*a*, and the second drive shaft 23*b* preferably extends through the hollow second steering shaft 32*a* in example embodiments described above, the present invention is not restricted to this. In an example embodiment of the present invention, the first steering shaft may alternatively extend through a hollow first drive shaft, and the second steering shaft may alternatively extend through a hollow second drive shaft.

While the drive shaft 23 preferably includes the first drive shaft 23*a* coaxial with the first steering shaft 31*a*, and the second drive shaft 23*b* coaxial with the second steering shaft 32*a* in example embodiments described above, the present invention is not restricted to this. In an example embodiment of the present invention, the drive shaft may alternatively include a first drive shaft that is not coaxial with the first steering shaft, or may include a second drive shaft that is not coaxial with the second steering shaft.

While the first steering shaft 31*a* is preferably located rearward of the second steering shaft 32*a* in the outboard motor main body 102 in example embodiments described above, the present invention is not restricted to this. In an example embodiment of the present invention, the first steering shaft may alternatively be located forward of the second steering shaft or may alternatively be located leftward or rightward of the second steering shaft in the outboard motor main body.

While the first angular range A1 is preferably 360 degrees in example embodiments described above, the present invention is not restricted to this. In an example embodiment of the present invention, the first angular range may alternatively be less than 360 degrees.

While the first steering 31 preferably includes the electric motor 31*b* to rotate the lower case 12*a* (first lower portion) in the right-left direction with respect to the hull 110, and the second steering 32 preferably includes the hydraulic pump 32*b* to integrally rotate the lower case 12*a* and the first steering storage case 12*b* (second lower portion) in the right-left direction with respect to the hull 110 in example embodiments described above, the present invention is not restricted to this. In an example embodiment of the present invention, the first steering may alternatively include a hydraulic pump to rotate the first lower portion in the right-left direction with respect to the hull, and the second steering may alternatively include an electric motor to integrally rotate the first lower portion and the second lower portion in the right-left direction with respect to the hull.

While the first angular range A1 in which the lower case 12*a* (first lower portion) is rotatable in the right-left direction with respect to the hull 110 by the first steering 31 is preferably larger than the second angular range A2 in which the lower case 12*a* and the first steering storage case 12*b* (second lower portion) are integrally rotatable in the right-left direction with respect to the hull 110 by the second steering 32 in example embodiments described above, the present invention is not restricted to this. In an example embodiment of the present invention, the first angular range in which the first lower portion is rotatable in the right-left direction with respect to the hull by the first steering may alternatively be equal to or smaller than the second angular range in which the first lower portion and the second lower portion are integrally rotatable in the right-left direction with respect to the hull by the second steering.

While the first steering 31 preferably rotates the lower case 12*a* (first lower portion) in the right-left direction about the first steering shaft 31*a* in the outboard motor main body 102 with respect to the hull 110, and the second steering 32 preferably integrally rotates the lower case 12*a* and the first steering storage case 12*b* (second lower portion) in the right-left direction about the second steering shaft 32*a* separate from the first steering shaft 31*a* in the outboard motor main body 102 with respect to the hull 110 in example embodiments described above, the present invention is not restricted to this. In an example embodiment of the present invention, the first steering may alternatively rotate the first lower portion in the right-left direction about the first steering shaft in the outboard motor main body with respect to the hull, and the second steering may alternatively integrally rotate the first lower portion and the second lower portion in the right-left direction about the first steering shaft with respect to the hull.

While the first steering 31 and the second steering 32 are preferably operable independently of each other in example embodiments described above, the present invention is not restricted to this. In an example embodiment of the present invention, the first steering and the second steering may not be operable independently of each other. That is, the first steering and the second steering may operate in conjunction with each other.

While two outboard motors 100 are preferably attached to the hull 110 side by side in the right-left direction in example embodiments described above, the present invention is not restricted to this. In an example embodiment of the present invention, three or more outboard motors may alternatively be attached to the hull side by side in the right-left direction.

While the operator 112 preferably includes the remote control and a steering wheel in example embodiments described above, the present invention is not restricted to this. In an example embodiment of the present invention, the operator may alternatively include a joystick. In such a case, the operator may include a joystick without including a remote control and a steering wheel, or may include a joystick in addition to a remote control and a steering wheel.

While the hydraulic cylinder 32*c* is preferably located below the cowling 11 in example embodiments described above, the present invention is not restricted to this. In an example embodiment of the present invention, the hydraulic cylinder may alternatively be located in the cowling.

While example embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

a bracket;

an outboard motor main body attachable to a hull via the bracket and including a lower portion including a first lower portion on which a propeller is provided and a second lower portion above the first lower portion, and an upper portion above the lower portion and including a drive source for the propeller; and a steering to rotate the lower portion in a right-left direction with respect to the hull, and that does not rotate the upper portion in the right-left direction with respect to the hull; wherein the steering includes a first steering to rotate the first lower portion in the right-left direction with respect to the hull, and a second steering to integrally rotate the first lower portion and the second lower portion in the right-left direction with respect to the hull.

2. The outboard motor according to claim 1, wherein the first steering and the second steering are operable independently of each other.

3. The outboard motor according to claim 2, further comprising:

a first steering shaft and a second steering shaft separate from the first steering shaft; wherein the first steering is operable to rotate the first lower portion in the right-left direction about the first steering shaft with respect to the hull; and the second steering is operable to integrally rotate the first lower portion and the second lower portion in the right-left direction about the second steering shaft with respect to the hull.

4. The outboard motor according to claim 3, wherein the first lower portion is rotatable in the right-left direction with respect to the hull within a first angular range by the first steering;

the first lower portion and the second lower portion are integrally rotatable in the right-left direction with respect to the hull within a second angular range by the second steering; and the first angular range is larger than the second angular range.

5. The outboard motor according to claim 4, wherein the first steering includes an electric motor to rotate the first lower portion in the right-left direction with respect to the hull; and the second steering includes a hydraulic pump to integrally rotate the first lower portion and the second lower portion in the right-left direction with respect to the hull.

6. The outboard motor according to claim 4, wherein the first angular range is 360 degrees.

7. The outboard motor according to claim 3, wherein the first steering shaft is rearward of the second steering shaft in the outboard motor main body.

8. The outboard motor according to claim 3, further comprising:

a propeller shaft in the first lower portion operable to rotate together with the propeller; and a drive shaft to transmit a driving force from the drive source for the propeller to the propeller shaft; wherein the drive shaft includes a first drive shaft coaxial with the first steering shaft, and a second drive shaft coaxial with the second steering shaft.

9. The outboard motor according to claim 8, wherein the first steering shaft is hollow, and the first drive shaft extends through the first steering shaft; and the second steering shaft is hollow, and the second drive shaft extends through the second steering shaft.

10. The outboard motor according to claim 3, wherein the outboard motor includes a plurality of outboard motors adjacent to each other; and the first steerings of the plurality of outboard motors are operable to rotate the first lower portions in the right-left direction about the first steering shafts with respect to the hull while the first lower portions and the second lower portions are integrally rotated in the right-left direction about the second steering shafts with respect to the hull by the second steerings while the first steering shafts are spaced apart from each other.

11. The outboard motor according to claim 1, wherein the upper portion includes an engine as the drive source for the propeller.

12. A marine vessel comprising:

a hull; and a plurality of outboard motors attached to the hull side by side in a right-left direction of the marine vessel; wherein each of the plurality of outboard motors includes:

an outboard motor main body including a lower portion including a first lower portion on which a propeller is provided and a second lower portion above the first lower portion, and an upper portion above the lower portion and including a drive source for the propeller; and a steering to rotate the lower portion in the right-left direction with respect to the hull, and to not rotate the upper portion in the right-left direction with respect to the hull; and the steering includes a first steering to rotate the first lower portion in the right-left direction with respect to the hull, and a second steering to integrally rotate the first lower portion and the second lower portion in the right-left direction with respect to the hull.

13. The marine vessel according to claim 12, wherein the first steering and the second steering are operable independently of each other.

14. The marine vessel according to claim 13, wherein each of the plurality of outboard motors further includes a first steering shaft and a second steering shaft separate from the first steering shaft in the outboard motor main body;

the first steering is operable to rotate the first lower portion in the right-left direction about the first steering shaft with respect to the hull; and the second steering is operable to integrally rotate the first lower portion and the second lower portion in the right-left direction about the second steering shaft with respect to the hull.

15. The marine vessel according to claim 14, wherein the hull includes a controller configured or programmed to control the first steerings and the second steerings of the plurality of outboard motors; and the controller is configured or programmed to control the first steerings of the plurality of outboard motors to rotate the first lower portions in the right-left direction about the first steering shafts with respect to the hull while controlling the second steerings of the plurality of outboard motors to integrally rotate the first lower portions and the second lower portions in the right-left direction about the second steering shafts with respect to the hull while the first steering shafts are spaced apart from each other.

16. The marine vessel according to claim 14, wherein the first lower portion is rotatable in the right-left direction with respect to the hull within a first angular range by the first steering;

the first lower portion and the second lower portion are integrally rotatable in the right-left direction with respect to the hull within a second angular range by the second steering; and the first angular range is larger than the second angular range.

17. The marine vessel according to claim 16, wherein the first steering includes an electric motor to rotate the first lower portion in the right-left direction with respect to the hull; and the second steering includes a hydraulic pump to integrally rotate the first lower portion and the second lower portion in the right-left direction with respect to the hull.

18. The marine vessel according to claim 16, wherein the first angular range is 360 degrees.

19. The marine vessel according to claim 14, wherein the first steering shaft is rearward of the second steering shaft in the outboard motor main body.

20. The marine vessel according to claim 14, wherein each of the plurality of outboard motors further includes:

a propeller shaft in the first lower portion operable to rotate together with the propeller; and a drive shaft to transmit a driving force from the drive source for the propeller to the propeller shaft; and the drive shaft includes a first drive shaft coaxial with the first steering shaft, and a second drive shaft coaxial with the second steering shaft.

* * * * *